US005327622A

United States Patent [19]

Coons et al.

[11] Patent Number: 5,327,622

[45] Date of Patent: Jul. 12, 1994

[54] HIGHLIGHTED NON-BLENDED CONTINUOUS FILAMENT CARPET YARN

[75] Inventors: Andrew M. Coons; Leonard C. Vickery; Melvin R. Thompson; Willis M. King, all of Anderson, S.C.

[73] Assignee: BASF Corporation, Parsippany, N.J.

[21] Appl. No.: 7,302

[22] Filed: Jan. 21, 1993

[51] Int. Cl.[5] ..... D02G 1/18

[52] U.S. Cl. ..... 28/220; 28/271; 28/219; 28/273

[58] Field of Search ..... 28/220, 271, 272, 274, 28/276; 57/91, 208, 350

[56] References Cited

U.S. PATENT DOCUMENTS

| | | | |
|---|---|---|---|
| Re. 31,376 | 9/1983 | Sheehan et al. | 57/208 |
| Re. 31,808 | 1/1985 | London et al. | 57/6 |
| 3,908,248 | 9/1975 | Schmid et al. | 28/1.4 |
| 4,070,815 | 1/1978 | Negishi et al. | 28/274 X |
| 4,080,777 | 3/1978 | Griset, Jr. | 57/91 X |
| 4,152,885 | 5/1979 | Cox, Jr. | 28/271 X |
| 4,152,886 | 5/1979 | Nelson | 28/271 X |
| 4,223,520 | 9/1980 | Whitted et al. | 28/276 X |
| 4,226,079 | 10/1980 | Mountney et al. | 28/220 X |
| 4,295,329 | 10/1981 | Windley | 28/220 X |
| 4,343,146 | 8/1982 | Nelson | 57/208 |
| 4,453,297 | 6/1984 | London, Jr. et al. | 28/271 X |
| 4,570,312 | 2/1986 | Whitener, Jr. | 28/271 |
| 4,736,578 | 4/1988 | Shaffer | 57/208 X |
| 4,841,606 | 6/1989 | Coons, III | 28/274 |
| 4,894,894 | 1/1990 | Coons, III et al. | 28/220 |
| 4,993,130 | 2/1991 | Coons, III et al. | 28/271 |
| 4,993,218 | 2/1991 | Schwartz et al. | 57/208 |
| 5,040,276 | 8/1991 | Coons, III et al. | 28/220 |
| 5,148,586 | 9/1992 | Coons, III et al. | 28/271 |
| 5,184,381 | 2/1993 | Coons, III et al. | 28/271 |
| 5,195,313 | 3/1993 | Coons, III | 28/271 X |

FOREIGN PATENT DOCUMENTS

| | | | |
|---|---|---|---|
| 5026661 | 10/1966 | Japan | 28/271 |

*Primary Examiner*—Clifford D. Crowder
*Assistant Examiner*—John J. Calvert
*Attorney, Agent, or Firm*—Karen M. Dellerman

[57] ABSTRACT

Moresque or berber continuous filament yarn is prepared by supplying a first group of continuous filaments to a first entangling zone where harsh nodes are created so that the first group has a yarn harshness of at least about 200. One or more other groups of continuous filaments, which are differentially precolored or dyeable with respect to the first group, are joined to the first group and interlaced sufficiently to cohere all groups of continuous filaments without blending with the tightly interlaced first group. The finished yarn has node harshness less than 100.

7 Claims, 6 Drawing Sheets

HIGHLIGHTED NON-BLENDED CONTINUOUS FILAMENT CARPET YARN

FIELD OF THE INVENTION

This invention relates generally to synthetic bulked continuous filament ("BCF") yarns. More particularly, this invention concerns continuous filament carpet yarns which include two or more groups of differentially precolored or dyeable filaments.

BACKGROUND OF THE INVENTION

As used herein, the term "continuous filament" or "continuous filament yarn" refers to fibers of indefinite or extreme length.

The terms "harsh nodes", "node harshness", and "yarn harshness" are as defined in U.S. patent application Ser. No. 07/619,377, now allowed, which is incorporated herein by reference.

The term "cohere" means to stick or hold together in a mass.

The term "blend" means to mix thoroughly so that constituent parts become nearly indistinguishable.

The term "moresque" refers to a multicolored yarn formed by twisting or plying single strands of different colors or a carpet made from such a yarn. Moresque carpet shows distinct medium to large color spots (about ⅛–¼). This is in contrast to heather carpet, which is made from single strands which are blended to give the impression of more uniform color.

The term "berber" refers to a carpet style with a distinctly colored bundle of strands in combination but not blended with the majority of fibers or base yarn.

One type of textured BCF yarn contains nodes or compact sections separated by bulky or unentangled sections such as shown in U.S. Pat. No. RE. 31,376 to Sheehan et al. Such yarns with compacted nodes and bulky or non-entangled sections are referred to herein as "interlaced".

U.S. Pat. No. 4,993,218 to Schwartz et al. describes another type of textured BCF yarn which has two different lengths of unentangled sections randomly separating compact sections.

As is known in the art, a carpet with a heather appearance may include small points of individual color randomly distributed throughout a matrix of contrasting colors. Heather BCF yarns can be made from differentially dyeable or precolored component yarns in various ways to provide a variety of heather appearances. These heather appearances can range from a very bold heather with relatively large (up to ⅛) random sections of individual color to a very fine (as small as 1/100") heather having a high degree of yarn-to-yarn filament commingling between the components.

Due to the high popularity of BCF moresque or berber yarns in the carpet market, distinctive novel yarn effects are in high demand. However, the preparation of acceptable new yarns has remained difficult due to the necessity of combining the component yarns in a sufficiently random yet consistent manner to obtain a distinctive and desirable appearance. Much of the difficulty in producing distinct moresque and berber yarns is the need to prevent the formation of directional carpet appearance or patterns, such as streaks and chevrons in the finished product. Some prior jet interlacing processes frequently rely on multiple tensions applied to the yarn components, which tensions tend to vary over time, requiring constant attention to the tension mechanisms. If it is desired to vary the tensions on several components to cause multiple colors to stand out randomly, making these tension changes quickly enough to prevent directional carpet appearance is extremely difficult. Other prior jet interlacing techniques rely on such a high degree of blending that the aesthetics of moresque or berber are impossible to achieve.

U.S. Pat. Re. 31,808 to London, Jr., et al. describes yarns having pronounced variations in linear density in a yarn where an effect component yarn is wrapped around a core yarn.

U.S. Pat. No. 4,343,146 to Nelson discloses a process for producing heather BCF yarns in which a first yarn is entangled with at least one second yarn which is precolored or differentially dyeable with respect to the first yarn. The second yarn contains frequent periodic short relatively compact regions of high filament entanglement. When the first and second yarns are textured according to the described Nelson process, the compact regions of the second yarn are substantially free from commingling with filaments of the first yarn. Between the compact regions are bulky or relatively open regions of textured first and second yarns.

Several co-owned patents such as U.S. Pat. Nos. 4,894,894; 4,993,130; and 5,040,276 have specified uniform blending to ensure a streak-free carpet. The resulting products of solution dyed or differentially dyeable BCF are intimately mixed heathers, not moresque or berber yarns. Otherwise, stria caused by sections of unblended fibers give the carpet directionality and can cause streaks. Sufficient blending of heavy denier yarns (greater than 10,000) is often impossible if the component colors are highly contrasting.

U.S. Pat. No. 5,148,586 to Coons III describes a-continuous filament yarn product which is interlaced to form a uniform linear density yarn product. The yarn product is formed from at least two component yarns which are differently colored or dyeable with respect to each other. The accent, or color point yarn is entangled, and the two yarns are commingled between compact regions in the color-point yarn, but substantially free from commingling in the compact regions of the color-point yarn to produce a random moresque appearance. This manner of constructing BCF heather yarn does not produce suitable results when the base yarn and the accent yarn are highly contrasting because the sections between the color points will be striated.

SUMMARY OF THE INVENTION

Accordingly, the present invention addresses the needs discussed above with a process for preparing moresque or berber continuous filament yarn by supplying a first group of continuous filaments to a first entangling zone and in the first entangling zone, creating harsh nodes in the first group of continuous filaments such that after said creating the group has a yarn harshness of at least about 200. One or more other groups of continuous filaments which are differentially precolored or dyeable with respect to the first group are then supplied and are joined to the first group. The tightly entangled first group is then interlaced with the one or more other groups of continuous filaments. The interlacing is sufficient to cohere all groups of continuous filaments without blending with the tightly interlaced first group such that the finished yarn has node harshness less than 100.

In another embodiment, an apparatus for making moresque or berber continuous filaments includes means for supplying a first group of continuous filaments to a first entangling zone; means for supplying one or more other groups of continuous filaments which are differentially dyeable or precolored with respect to the first group; a first entangling device including a fluid jet adapted to for harsh nodes in multiple filament yarn passing therethrough; means for feeding the first group of continuous filaments to the first entangling device; a second entangling device having a fluid jet adapted to cohere the first group of filaments and one or more other groups of filaments without blending them; and disposed between the first entangling means and the second entangling means, means for joining the first group of continuous filaments and one or more other groups of continuous filaments such that the yarn harshness of the joined yarn is less than 100.

In a further embodiment a moresque carpet yarn includes a first group of continuous filaments having spaced portions of harsh nodes; and cohered thereto without blending with the first group, one or more other groups of continuous filaments which are differentially dyeable or precolored with respect to the first group.

In yet another embodiment, a berber carpet yarn has a distinctly colored fiber bundle in combination with but not blended with the majority of fibers or base yarn.

It is an object of the invention to provide a process for preparing moresque or berber continuous filament yarn.

It is another object of the invention to provide an apparatus for making continuous filaments useful for making moresque or berber carpets.

A further object of the invention is to introduce a moresque or berber carpet yarn and tufted and level loop carpets made therefrom.

Related objects and advantages of the present invention will be readily apparent to one ordinarily skilled in the art after considering the following written description and accompanying figures.

DESCRIPTION OF THE PREFERRED EMBODIMENTS

Figure 1:
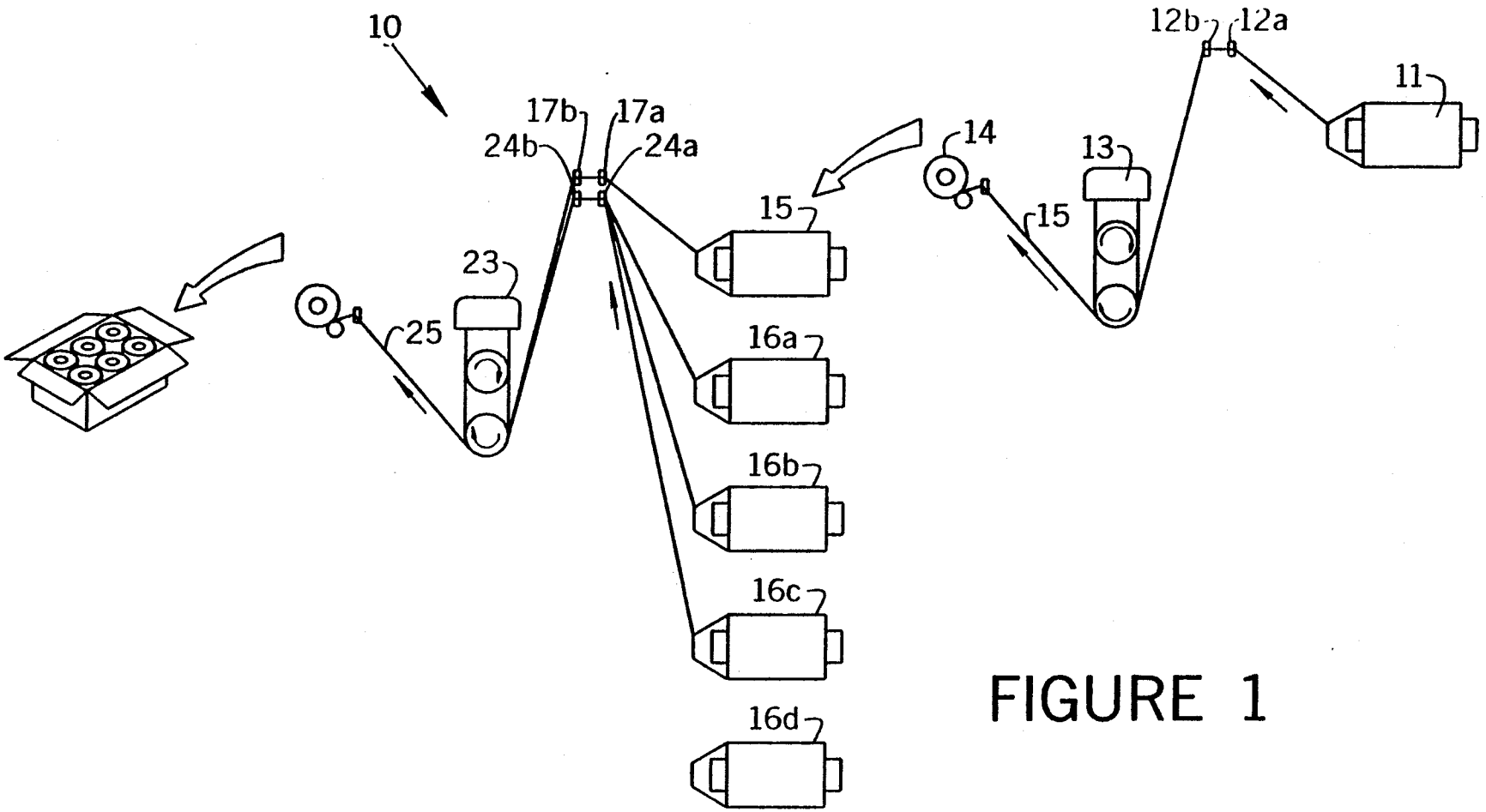
FIG. 1 is a schematic representation of an apparatus according to the present invention.

To promote an understanding of the principles of the present invention, descriptions of specific embodiments of the invention follow, and specific language describes the same. It will nevertheless be understood that no limitation of the scope of the invention is thereby intended, and that such alterations and further modifications, and such further applications of the principles of the invention as discussed are contemplated, as would normally occur to one ordinarily skilled in the art to which the invention pertains.

The present invention provides a carpet yarn for preparing moresque and berber carpet yarn with remarkable uniformity due to the elimination of blending streaks during cabling or conventional air entangling. Yet, process economics are not sacrificed. The carpet yarn of the invention will have color points due to the accent component but, since no blending has occurred, the potential for carpet streaks is almost nonexistent. Industry standards, i.e., streak grading (1–10), allow shipping a 6½–7 streak graded carpet as first quality. The carpet made with the yarn of the present invention will consistently be at least 9. Especially surprising is that difficult color combinations, i.e., those that are known to frequently streak, such as red and green, can be made with excellent results. Moreover, it is remarkable how consistent the carpets are, even when heavy denier yarn is used. The yarn deniers greater than 10,000 do not cause any difficulties not experienced with more conventional (2,000 to 10,000) denier yarns. Carpets may be formed into any conventional carpet construction, such as cut, pile, or level loop.

One embodiment of the present invention is a process for preparing continuous filament yarn useful in making moresque or berber carpets. The process includes supplying a group of accent filaments to an entangling zone. In this entangling zone, harsh nodes are created in the group of accent filaments such that after entangling, the yarn harshness of the accent yarn is at least about 200.

Then, one or more other groups of base filaments which are differentially precolored or dyeable with respect to the group of accent filaments is joined to the accent group. After joining, all the groups are interlaced sufficiently to cohere all the groups without causing blending of the base filaments with the tightly interlaced first group of filaments. The prior entanglement in the first group of filaments will prevent any blending between the accent and the base yarn. However, the base yarn will wrap around the accent yarn, making one yarn for easy tufting.

The base yarn can be any solid color or non-contrasting heather, and may include one or more groups of filaments to create a variety of results. For example, conductive filaments may be added to give the carpet antistatic properties.

Harsh nodes are created in the accent group of filaments by interlacing using high tension and air pressure. Tensions of at least 0.1 gram per denier and air pressure of at least 90 psig may be used to create these harsh nodes. Advantageously, a tandem interlacer as described in U.S. patent application Ser. No. 07/619,377 may be used to make the harsh nodes in the accent filaments. Alternatively, a single interlacing unit may be used. In either case, the tension and air pressure must be adjusted until sufficiently close (consistently less than 1" apart) hard nodes are achieved. The notched interlacer described in U.S. Pat. No. 4,841,606 is preferred for use in the invention. Preferred yarn speeds are about 750 yards per minute for a tandem interlacer and 600 yards per minute for a single interlacer.

The accent yarn is then interlaced with the other base yarns. This may be done according to steps for making soft node yarns described in U.S. patent application Ser. No. 07/619,377, and preferably using an air pressure of 60 to 80 units psig. Preferably, the joined yarn travels at about 750 yards per minute.

A second embodiment of the present invention is an apparatus for making moresque or berber continuous carpet filaments. A suitable apparatus is illustrated in FIG. 1.

FIG. 1 is a schematic of an exemplary apparatus of the second embodiment of the invention. Apparatus 10 converts unentangled BCF yarn 11 having less than 10 nodes/meter into streak-free moresque or berber carpet yarn. Unentangled BCF yarn 11 (500–3,000 denier) is unwound, passed through guides 12*a* and 12*b* and routed to an entangling system 13. The entangling system 13 shown is according to U.S. patent application Ser. No. 07/619,377, except that system is operated to make many hard nodes and harsh yarn 15. Harsh yarn 15 has greater than 40 nodes/meter and a yarn harshness of greater than 200. Harsh yarn is made using air pressure greater than 90 psig supplied to the jet interlacer and yarn tension greater than 0.1 grams/denier. It is preferable that the yarn have harshness in excess of 200 (07/821,258). After interlacing, harsh yarn 15 is wound up on winder 14.

Harsh yarn 15 is then positioned in a second stage of apparatus 10 where harsh yarn 15 is combined with base yarns 16*a*, 16*b*, 16*c*, and 16*d*. More or less base yarns may be supplied to form the desired end result. The base yarns 16 may be different or alike with respect to each other. The base yarns 16 are supplied unentangled. Harsh yarn 15 is guided via guides 17*a* and 17*b* to second interlacing system 23. Base yarns 16 are gathered at guides 24*a* and 24*b* and guided to second interlacing system 23, where they join harsh yarn 15. Second interlacing system 23 preferably has the design of and is operated as described in U.S. patent application Ser. No. 07/619,377. The resulting yarn 25 has highly entangled harsh yarn 15 tied into the non-entangled base yarn 16.

Figure 2:
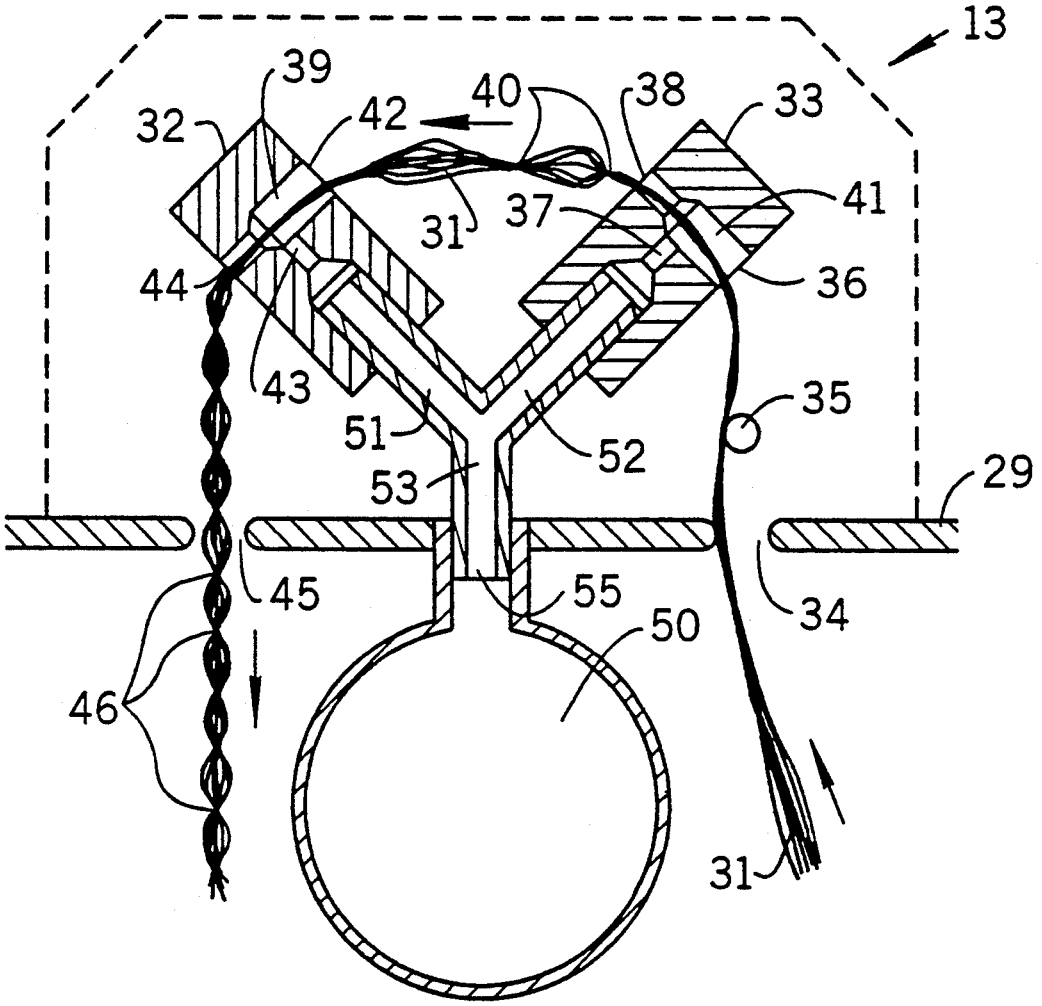
FIG. 2 is an elevational cross-sectional view of an interlacing apparatus useful to prepare the accent yarn of the present invention.

Interlacing apparatus 13 and 23 are shown in more detail in FIG. 2. FIG. 2 shows interlacing apparatus 13 (apparatus 23 is similar in all respects) installed with the apparatus of the process disclosed in U.S. Pat. No. 4,570,312 to Whitener, Jr. That patent is hereby incorporated by reference for the process taught therein and for purposes of illustrating how the present apparatus may be used in interlacing operations. It will be recognized that the illustration of the present invention with the process of U.S. Pat. No. 4,570,312 is not intended to limit the scope of the invention but is intended to enhance an understanding of the invention. As shown, apparatus 13 is mounted on housing 29 in the position of the interlacing head and includes interlacers 32 and 33 arranged in series. One suitable interlacer for use in the present apparatus is described in U.S. Pat. No. 4,841,606 to Coons, III, which is hereby incorporated by reference as an example of a useful interlacer. Guide pin 35 is optional. Each interlacer 32 and 33 includes a yarn passageway 39 and 41, respectively, and air jet/orifice inlet 43 and 37, respectively. Air jet/orifice inlets 43 and 37 are connected to air supply 50 through conduits 51 and 52, respectively. Yarn passageways 39 and 41 include yarn inlets 42 and 36, respectively, and yarn outlets 44 and 38 in continuous communication therewith.

Yarn 31 is shown moving through a set of interlacers 32 and 33 in the direction of the arrows. Untangled multifilamentary yarn enters interlacing apparatus 13 through apparatus feed port 34 and may contact pin 35, if pin 35 is present. The yarn then enters the inlet port 36 of interlacer 33 where yarn 31 is subjected to a stream of forced fluid. The fluid enters yarn passageway 41 at air inlet 37. The action of the fluid causes entangling of the yarn. The yarn then exits first interlacer 33 through outlet port 38. As shown, the action of first interlacer 33 results in the formation of nodes 40.

Continuing in its path, yarn 31 then enters second interlacer 32 through its yarn inlet 42 where yarn 31 is subjected to fluid impingement in yarn passageway 39 through inlet 43. Yarn 31 then exits second interlacer 32 through yarn outlet 44. As a result, additional nodes 46 are formed in portions of yarn 31 left unentangled by first interlacer 33. For this reason, the interlacers should operate independently. Yarn 31 then exits interlacing apparatus 30 through apparatus exit port 45.

Fluid is supplied to interlacers 32 and 33 from fluid supply 50. Air is one suitable fluid. Conduits 51 and 52 supply a predetermined fluid pressure to respective interlacers 32 and 33. As shown, individual conduits 51 and 52 may join so that after junction 53 they form a main fluid supply conduit 55.

Where soft node yarn is desired (such as made with interlacer 23), interlacer 32 and interlacer 33 should be arranged to operate independently. This means that the action of first interlacer 33 will not interfere with the interlacing action of second interlacer 32. The first interlacer will not interfere if none of the interlacing action it imparts to the yarn is left when the yarn enters the second interlacer. The relative angular relationship of the interlacers helps assure this result.

In addition to the effectiveness of the total interlacing action, each interlacer is supplied with relatively high air flow/pressure. In general, the fluid is supplied continuously to the interlacers used in the present invention. Where the interlacer of U.S. Pat. No. 1,841,606 is used, the apparatus of the present invention obtains enhanced efficiency. The notches present in the yarn passageway of that interlacer guide the yarn into the region of fluid impingement. It is contemplated that any interlacer having means to guide the yarn into the fluid jet will achieve some degree of improved efficiency over interlacers which allow the yarn to move freely through the cross section of the interlacer. The interlacers should preferably be aligned with the air orifice or jet perpendicular to the thread path. The yarn most preferably passes directly over the air jet. It is presently believed that interlacers which operate based on free movement of the yarn in the entanglement chamber will be less efficient in the present invention.

While the above discussion focused on dual jet interlacing to make the accent yarn, a single interlacer can also be used. When a single interlacer is used, the yarn speed is preferably below 600 mpm, and the air pressure and yarn tension are preferably from 120 to 140 psig and from 0.1 to 0.2 grams/denier, respectively.

Apparatus 23 in the second, or cohering phase, may be designed in the same manner as described in connection with FIG. 2. The air pressure and tension are, however, reduced and the yarn speed is increased.

Figure 3A:
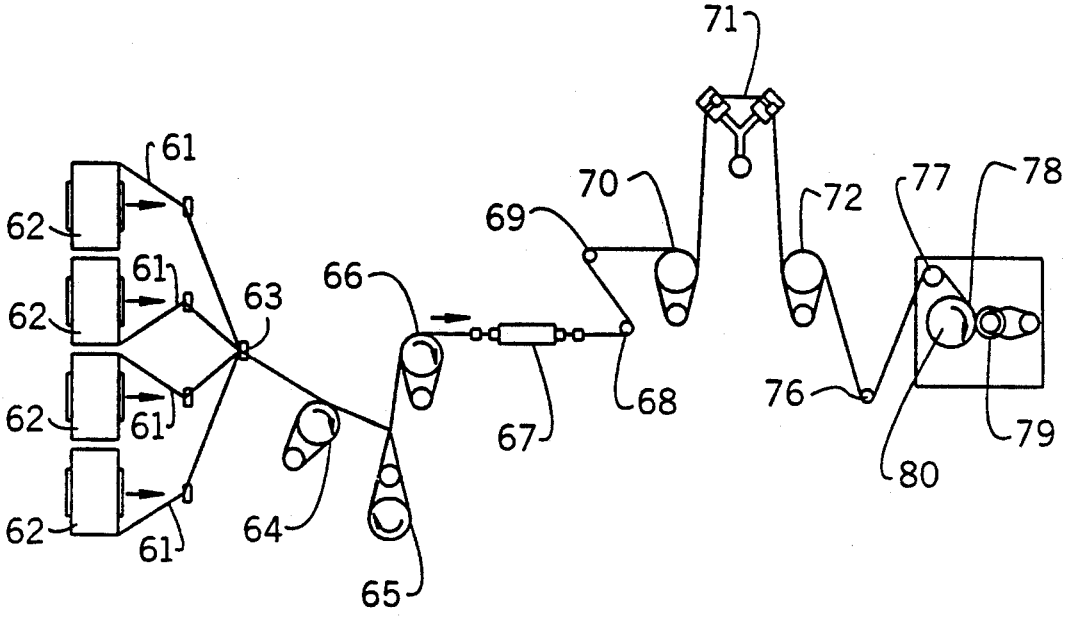
FIGS. 3*a*, 3*b*, and 3*c* are schematic representations of a variation of the apparatus of FIG. 1.
Figure 3B:
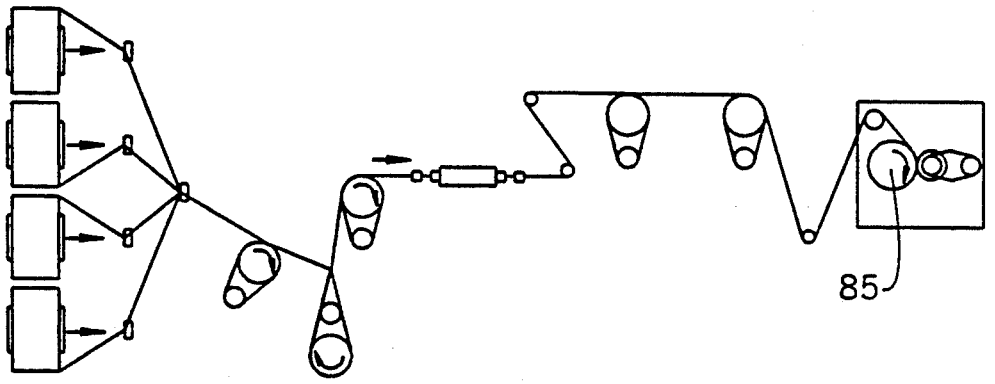
Figure 3C:
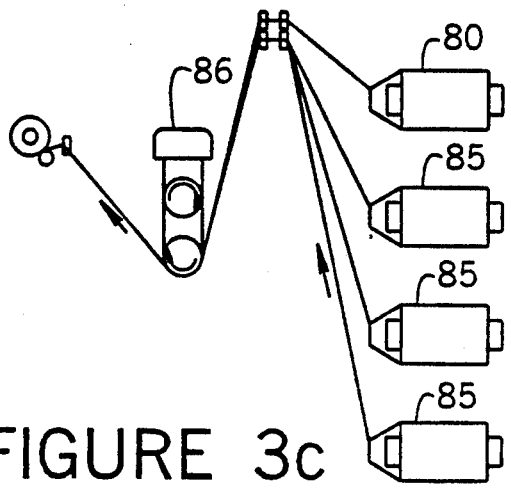

FIG. 3 schematically illustrates an alternative apparatus of the second embodiment of the present invention wherein one yarn is concurrently drawn, bulked and entangled. Undrawn feed yarn 61 is taken off of packages 62, fed through first guide 63 and makes about three wraps around first godet 64. First godet 64 is used to pretension the yarn. The yarn is then drawn between second godet 65 and third godet 66. The yarn makes seven or eight wraps around both second godet 65 and third godet 66. Yarn 61, now drawn, is then texturized in texturizing tube 67. One useful texturizing tube is described in U.S. Pat. No. 3,908,248. Now texturized yarn 61 travels over direction changing roll 68 and tension device 69 after which the yarn contacts a fourth godet 70 and a fifth godet 72. The texturized yarn is overfed from fourth godet 70 to fifth godet 72. Between godets 70 and 72 is situated interlacer apparatus 71. Interlacer apparatus 71 is as described in connection with FIG. 2 above. After exiting fifth godet 72, yarn 61 passes over another direction, changing roller 76 and onto transverse rolls 77 of a winder. Yarn package 78 is then built up upon a package 78. Package 78 is driven by friction roll 79. In this manner the final yarn is entangled, drawn and bulked in a single integrated process. The accent yarn 80 produced has a high node count (>40 nodes/meter) and yarn harshness in excess of 200.

Non-entangled yarns 85 are made in a nearly identical apparatus 86, without interlacer 71.

Accent yarn 80 is combined with the non-entangled yarn 85 in air entangling apparatus 86 to make a combined yarn having a yarn harshness less than 100. Apparatus 86 for combining base yarn 85 and accent yarn 80 operates in the same manner as described in connection with FIG. 1. The resulting BCF yarn has the highly entangled yarn 80 tied into but not blended with the base yarns 85.

In the following examples, the following test was used.

Streak Grading

Carpet streak grades are intended to define commercial status, i.e., whether a carpet is streakless enough to send to a customer, or if it should be sold at a discount price. A grade is assigned by looking at at least 10 feet (length) of a 12 foot (width) carpet under "daylight" fluorescent lights. The grader gives the carpet a score from 1 to 10 based on visual appearance of streaking.

10 Flawless. No streaks.

9 Barely perceptible streaks to a trained grader.

8 Streaks noticeable to trained grader, but not the consumer.

7 Streaks perhaps noticeable to consumers, but not objectionable.

6 Objectionable streaks are noticeable to consumer (untrained grader). Usually, this carpet is discounted 10–30% in price.

5 Very objectionable streaks. Second or third grade carpet. Heavily discounted in price.

1–4 Looks as if different types of yarn were accidentally tufted into the same carpet.

The invention will be described by reference to the following detailed examples. The Examples are set forth by way of illustration, and are not intended to limit the scope of the invention. In the examples, all parts are part by weight unless otherwise specified.

EXAMPLE 1

Moresque Carpet Yarn

Trilobal, solution-dyed continuous filament nylon 6 light gray 1115 denier 58 filament yarn is supplied at 750 ypm to a tandem interlacer as shown in FIG. 1. A tension of more than 0.1 g/denier is maintained on the yarn and it is subjected to interlacing action of air pressure at 90 psig. The yarn has a harshness of 207.

Three 1115 denier 58 filament trilobal solution dyed blue nylon 6 yarns and two identical black yarns are fed along with the light gray yarn to another interlacer at 750 ypm. A tension of less than 0.1 g/denier is maintained. The pressure is 70 psig. The six yarns are interlaced to form a yarn with total harshness of 92.

Figure 4:
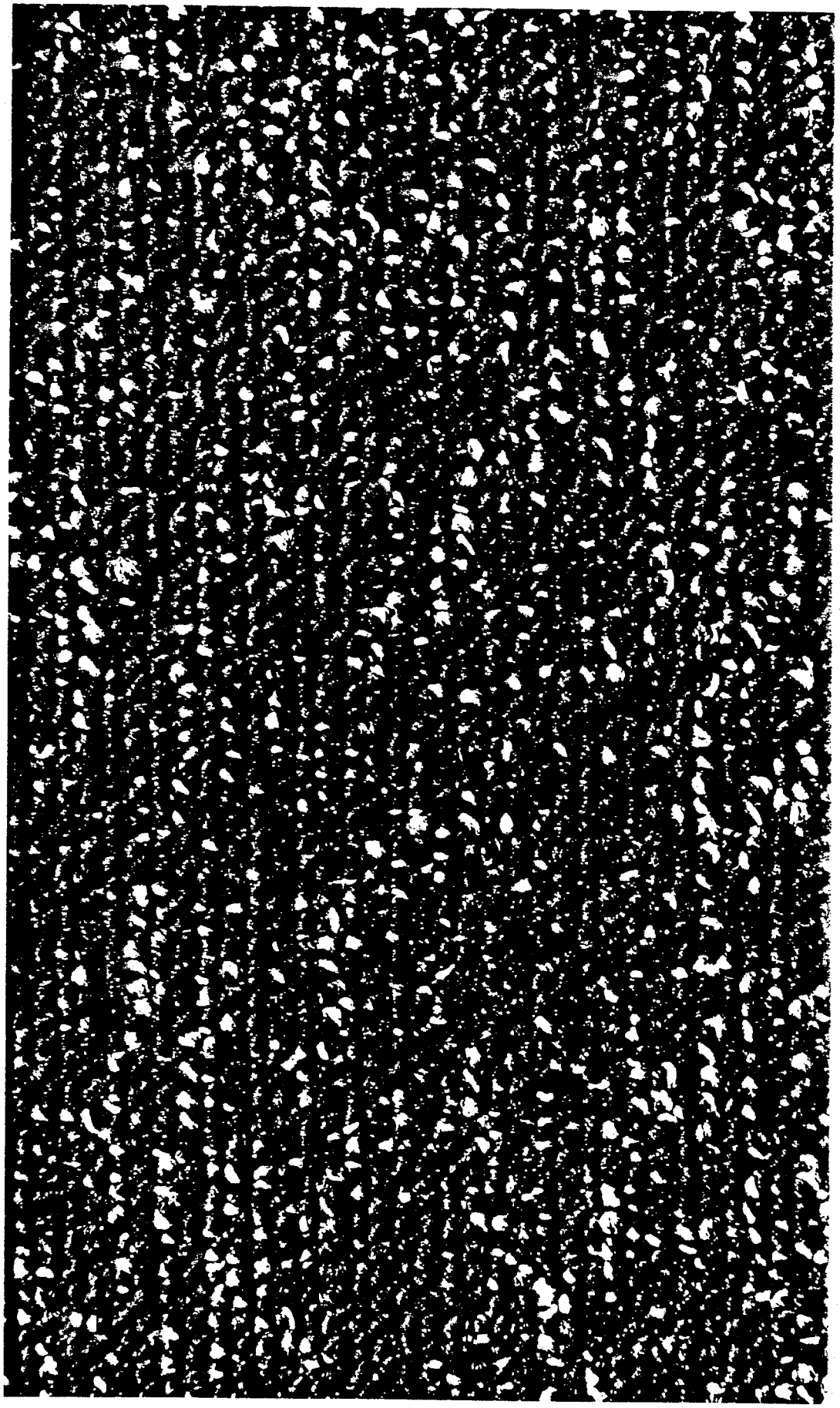
FIGS. 4–6 are photographs of carpets according to the present invention.

A 28 oz/yd level loop carpet is made by standard carpet making techniques. The carpet is shown in FIG. 4. The carpet streak grade is 10.

EXAMPLE 2

Moresque Carpet Yarn

Trilobal, solution-dyed continuous filament nylon 6 dark green 1115 denier 58 filament yarn is supplied at 750 ypm to a tandem interlacer as shown in FIG. 1. A tension of more than 0.1 g/denier is maintained on the yarn and it is subjected to interlacing action of air pressure at 90 psig. The yarn has a harshness of 210.

Four 1115 denier 58 filament trilobal solution dyed coral nylon 6 yarns are fed along with the dark green yarn to another interlacer at 750 ypm. A tension of less than 0.1 g/denier is maintained. The pressure is 70 psig. The five yarns are interlaced to form a yarn with total harshness of 87.

Figure 5:
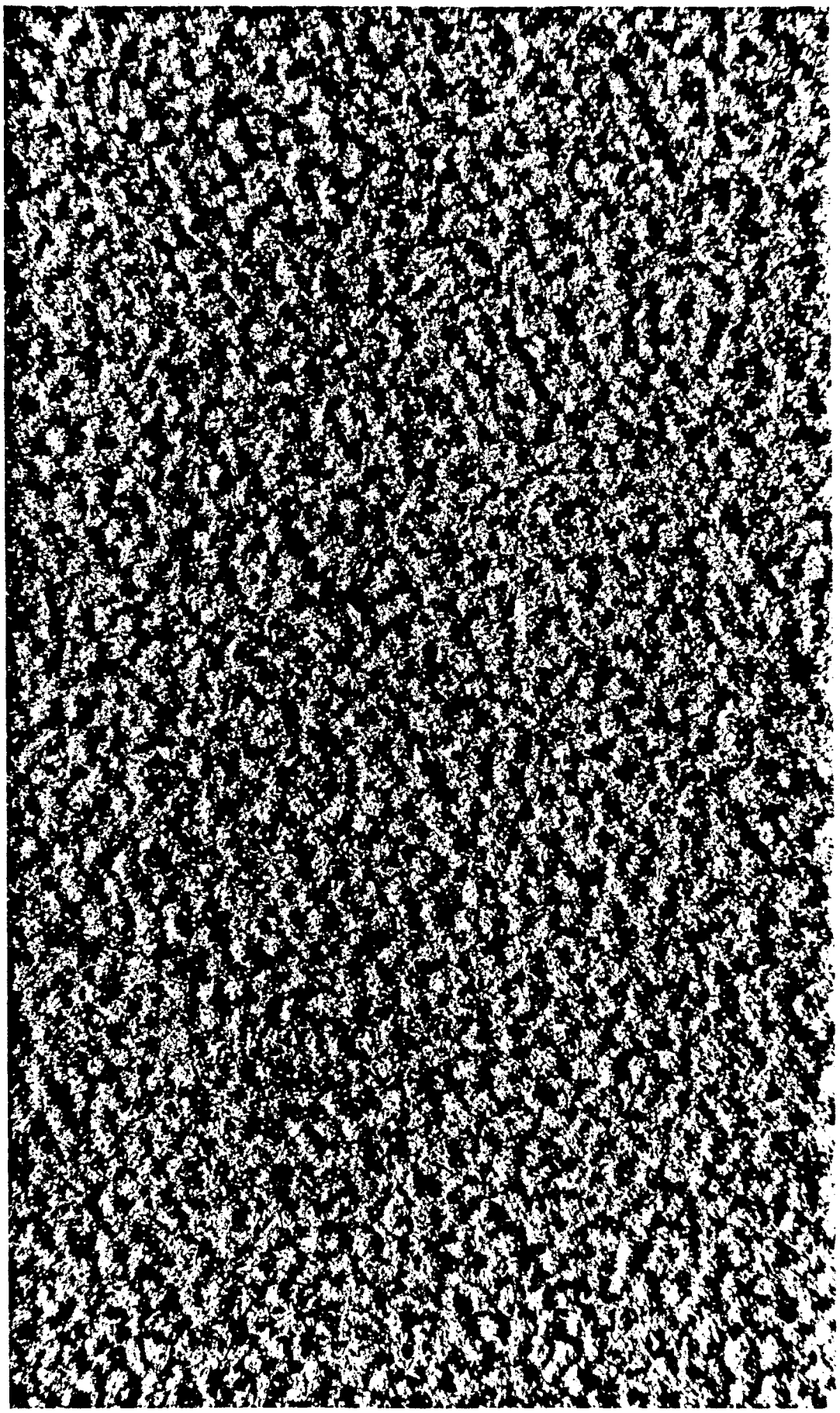

A 42 oz/yd cut pile carpet is made by standard carpet making techniques. The carpet is shown in FIG. 5. The carpet streak grade is 10.

EXAMPLE 3

Berber Carpet Yarn

Two trilobal, solution-dyed continuous filament nylon 6 beige 1115 denier 58 filament yarns (one coral and one beige) are supplied at 750 ypm to a tandem interlacer as shown in FIG. 1. A tension of more than 0.1 g/denier is maintained on the yarn and it is subjected to interlacing action of air pressure at 90 psig. The yarn has a harshness of 214.

Three 1115 denier 58 filament trilobal solution dyed light gray nylon 6 yarns, three 1115 denier 58 filament trilobal solution dyed medium gray nylon 6 yarns, and three 1115 denier 58 filament trilobal solution dyed dark gray nylon 6 yarns are fed along with the coral and beige yarns to another interlacer at 750 ypm. A tension of less than 0.1 g/denier is maintained. The pressure is 70 psig. The eleven yarns are interlaced to form a yarn with total harshness of 56.

Figure 6:
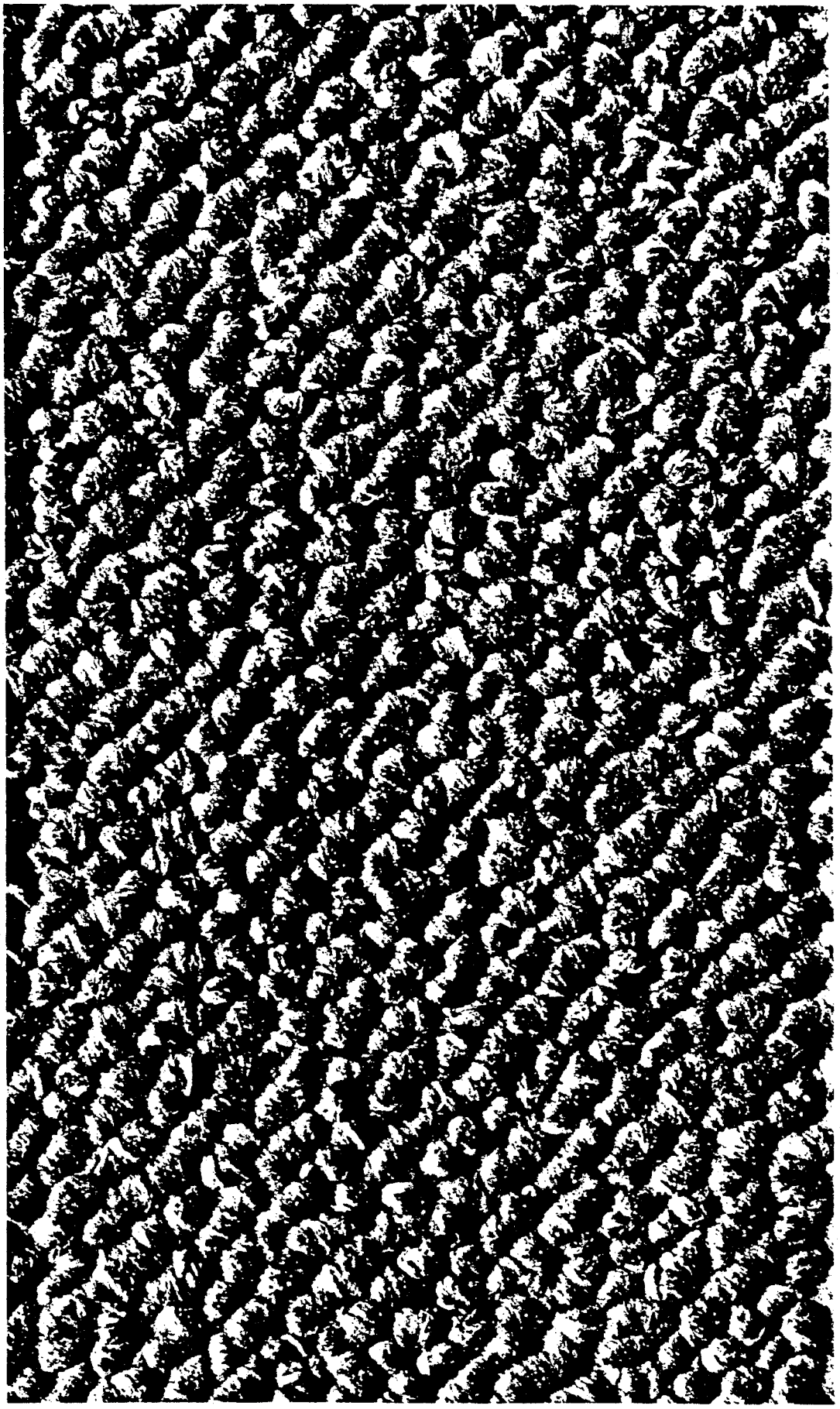

A 36 oz/yd level loop carpet is made by standard carpet making techniques. The carpet is shown in FIG. 6. The carpet streak grade is 10.

What is claimed is:

1. A process for preparing moresque or berber continuous filament yarn comprising:

(a) supplying a first group of continuous filaments under tension to a first entangling zone where the first group of continuous filaments is impinged with fluid under pressure;

(b) subjecting the first group of continuous filaments to entangling by fluid impingement in the first entangling zone, wherein during said entangling, providing sufficiently high yarn tension and fluid pressure to create harsh nodes in the first group of continuous filaments such that after said subjecting the group has a yarn harshness of at least about 200;

(c) supplying one or more other groups of continuous filaments which are differentially precolored or dyeable with respect to the first group;

(d) joining the first group and the other groups after said subjecting; and (e) interlacing under tension and by the action of a fluid the tightly entangled first group with the one or more other groups of continuous filaments, said interlacing taking place under a yarn tension and fluid pressure sufficient to cohere all groups of continuous filaments without blending the tightly interlaced first group with the one or more other groups such that after said interlacing the finished yarn has node harshness less than 100.

2. The process of claim 1 wherein said creating is by exposing the first group to a dual interlacing action.

3. The process of claim 1 wherein said creating is with air at a pressure of at least 90 psig impinged on the first group.

4. The process of claim 3 wherein said creating is with tension on the first group of at least 0.1 g/denier.

5. The process of claim 1 wherein said interlacing is by dual interlacing action.

6. The process of claim 1 wherein said interlacing is at an air pressure of less than 90 psig impinged on the joined yarn.

7. The process of claim 6 wherein said interlacing is at a yarn tension of less than 0.1 g/denier.

* * * * *